United States Patent [19]

Arrant

[11] Patent Number: 4,588,189

[45] Date of Patent: May 13, 1986

[54] MANIPULATING LARGE SECTIONS OF ARTIFICIAL TURF

[75] Inventor: Kearney D. Arrant, Florissant, Mo.

[73] Assignee: Monsanto Company, St. Louis, Mo.

[21] Appl. No.: 603,000

[22] Filed: Apr. 23, 1984

[51] Int. Cl.[4] ..... A63C 19/12

[52] U.S. Cl. ..... 273/27; 242/86.52

[58] Field of Search ..... 273/27, 3; 254/203, 254/202; 242/54 R, 55, 56 R, 85, 86.52

[56] References Cited

U.S. PATENT DOCUMENTS

| | | | |
|---|---|---|---|
| 974,091 | 10/1910 | O'Donnell | 273/27 |
| 1,052,498 | 2/1913 | McDonald | 273/27 |
| 1,088,407 | 2/1914 | Derr | 273/27 |
| 1,966,687 | 7/1934 | Scott et al. | 273/27 |
| 3,099,444 | 7/1963 | Burt | 273/27 |
| 3,395,918 | 8/1968 | Scoville | 273/27 |
| 4,399,954 | 8/1983 | Arrant | 273/27 |

FOREIGN PATENT DOCUMENTS

| | | | |
|---|---|---|---|
| 1493929 | 7/1967 | France | 273/27 |

*Primary Examiner*—Richard C. Pinkham
*Assistant Examiner*—T. Brown
*Attorney, Agent, or Firm*—Thomas E. Kelley; Arthur E. Hoffman

[57] ABSTRACT

Apparatus for manipulating large sections of non-rectangular shaped artificial turf which facilitates repeated covering and uncovering of a surface with such turf. The apparatus comprises at least one belt removably attached to an oblique margin of the artificial turf to provide non-deflecting support for a roll of artificial turf wrapped onto an elongated cylindrical pole. More specifically, the apparatus allows for a non-rectangular shaped segment of artificial turf, for instance, such as utilized in a baseball field, to be deployed and recovered with the assistance of a pneumatic cushion.

4 Claims, 6 Drawing Figures

MANIPULATING LARGE SECTIONS OF ARTIFICIAL TURF

BACKGROUND OF THE INVENTION

This invention relates to a method and apparatus for manipulating large sections of non-rectangular-shaped artificial turf, and more specifically to a method and apparatus facilitating repeated covering and uncovering of a surface with such turf.

Artificial turf installations in recent years have become quite widespread for indoor and outdoor uses. In a typical convertible indoor installation rectangular-shaped sections of artificial turf have been installed to removably cover a support surface in that it is repeatedly rolled up and stored after each use so the area underneath can be used for other purposes. For example, such a convertible system has been used in manually covering a basketball floor with synthetic turf where it is used for football practice and then manually rolled up and stored nearby in large rolls to expose the floor for use in playing basketball. Aside from the need for extensive manpower to roll out and roll up the large sections of artificial turf, the drawback to this approach is the lack of an effective way to manipulate the large artificial turf area to remove wrinkles which develop during the roll up and roll out phases.

A significant improvement is disclosed in U.S. Pat. No. 4,399 954, incorporated herein by reference, which discloses the manipulation of large sections of artificial turf supported on a pneumatic cushion. To cover a field the artificial turf is pulled from a roll of artificial turf supported along its length by support rollers. For instance, an entire football field can be pulled from the roll because friction between the artificial turf and the support surface is minimized with a pneumatic cushion, provided by a blower feeding low pressure air to a few ports in a row adjacent the roll, which is often below grade. When the field is extended the blower is shut down allowing the artificial turf to settle onto the support surface. The artificial turf can be rapidly removed by applying a pneumatic cushion then winding the artificial turf onto the roll, for instance by driving the support rollers.

Such a rapid field conversion system has benefited the management of multi-use stadia by allowing the scheduling of events more closely together to maximize facility use. For instance a football game can be played on artificial turf supported over a basketball court on the same day as a basketball game due to the minimal time required for field conversion, often less than one hour.

In this regard FIG. 1 illustrates a plan view of a central portion of a stadium having a football playing field with a rapid conversion apparatus. The central section of the stadium is bounded by a circular circumference 2, within which are seating segments 3 which can move for instance on circular arc tracks. A football playing field 1 of artificial turf can be installed by pulling the turf on a pneumatic cushion provided from ports adjacent a pit 6. The air cushion supported turf can be pulled from a roll stored in the pit 6 by cables 7 attached to a spar 8 at the leading margin of the turf. Winches 9, within the seating segments 3 pull on the cables 7 which are guided by capstans 10 and pulleys 11.

To remove the field, a pneumatic cushion is provided via the ports. With reference to FIG. 2, the turf is wrapped onto a cylindrical core 12 by driving support roller 13. A support roller 14 assists in supporting the roll as its diameter changes. When the artificial turf is removed from the field, a lid 15 can be closed down over the pit 6.

A principal disadvantage of such rapid field conversion systems is that they are not amenable to use in those facilities where non-rectangular-shaped artificial turf is utilized, such as for playing baseball. For purposes of describing this invention a non-rectangular-shaped segment of artificial turf is defined as having a margin which extends at an oblique angle from the edge of the segment which is fastened to an elongated core onto which the artificial turf can be wrapped.

If a non-rectangular-shaped segment of artificial turf were wrapped into a roll, an irregular circumference would result. Artificial turf, for instance comprising a mat of synthetic grass and a resilient polymeric cushion, can have a density in the range from about 0.4–2.0 pounds per square foot (2–10 Kilogram per square meter), for instance about 1.0 pound per square foot (4.9 Kilogram per square meter). Artificial turf for a baseball playing field would often be wrapped in a roll of at least about 400 feet (122 meters) in length and have a mass on the order of magnitude of 100,000 pounds (45,400 Kilograms). Any attempt to wrap such a non-rectangular segment of artificial turf of such large mass onto a cylindrical core of about 400 feet (122 meters) in length would readily result in a bent core incapable of rotation.

By this invention applicant has provided apparatus for rapid field conversion of non-rectangular surfaces of artificial turf, such as for a baseball playing field, with apparatus that will allow for non-deflecting support to the artificial turf-wrapped core.

SUMMARY OF THE INVENTION

This invention provides apparatus for covering a surface with a non-rectangular-shaped, large section of artificial turf. Such artificial turf is arranged with a straight edge of the artificial turf fastened to an elongated cylindrical core. At least one oblique margin of the turf extends at an oblique angle from the axis of the core. When the artifical turf is wrapped on the cylindrical core, the outer diameter of the roll of artificial turf will vary because of the oblique margin. To provide non-deflecting support to the roll of artificial turf wrapped onto the cylindrical core at least one belt of substantially the same thickness as the artificial turf is removably attached to said oblique margin to provide support between the roll of artificial turf and support rollers.

DESCRIPTION OF A PREFERRED EMBODIMENT

The apparatus of this invention comprises at least one belt which provides non-deflecting support for the roll of artificial turf wrapped onto an elongated cylindrical core. Such belt is removably attached to an oblique margin of the artificial turf and extends in a direction perpendicular to the axis of the core to at least a point distant from the core equivalent to the most distant edge of the artificial turf. To provide non-deflecting support the belt has a thickness substantially the same as the thickness of the artificial turf in the length of the belt between said oblique margin and said point.

The belt can comprise a single belt extending and adjoining the oblique margin of the artificial turf to form a rectangular-shaped segment of artificial turf and belt. Such single belt is provided on an elongated core parallel to the core supporting the roll of artificial turf.

Preferably the at least one belt comprises a plurality of narrow belts provided on a plurality of cores arranged parallel to the core supporting the artificial turf. Each of said belts would be of varying length to extend from varying points along the oblique margin to at least the extended length of the artificial turf. Such plurality of belts is spaced at a lateral distance sufficient to provide non-deflecting support between the artificial turf wrapped on the core and at core support rollers. The appropriate lateral distances depend on such factors as belt width, the density of the artificial turf, the bending modulus of the cylindrical core and the load limit of the support rollers. Lateral distances of between 3 and 15 meters may be typical.

The apparatus also comprises powered rollers for supporting and driving a roll of said artificial turf wrapped on said core. Also provided for installing the turf is means for pulling the leading margins of the turf.

The apparatus must also comprise means for developing air pressure under the section of artificial turf to allow the section to readily move over the support surface with minimal frictional resistance.

Figure 6:
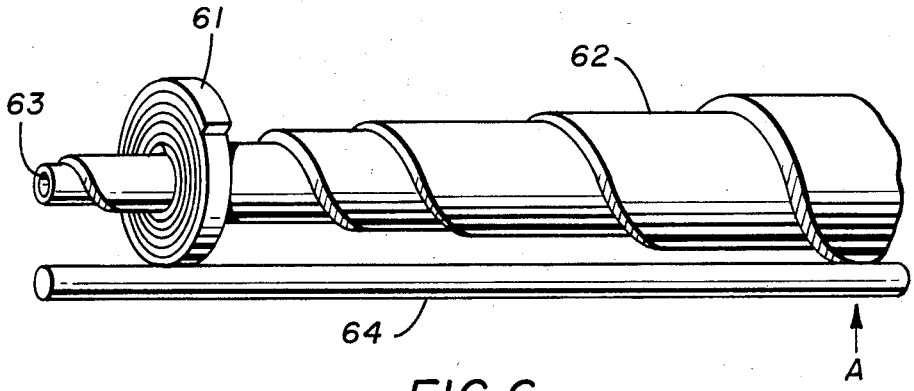
FIG. 6 illustrates a belt providing non-deflecting support to a roll of artificial turf with an oblique margin.

In FIG. 6 belt 61 provides non-deflecting support to a roll of artificial turf 62 having an oblique margin wrapped on a cylindrical core 63. The roll of artificial turf is supported by support roll 64 above point A. The belt has substantially the same diameter as the artificial turf, which comprises a layer of synthetic grass over a polymeric resilient foam pad. The belt is attached to the artificial turf at an oblique margin. As the roll is advanced, the diameter of layers of the belt correspond to the largest diameter of the wrapped artificial turf. Thus the belt provides support for the otherwise unsupported portions of the roll to prevent deflection and deformation of the cylindrical core.

Figure 1:
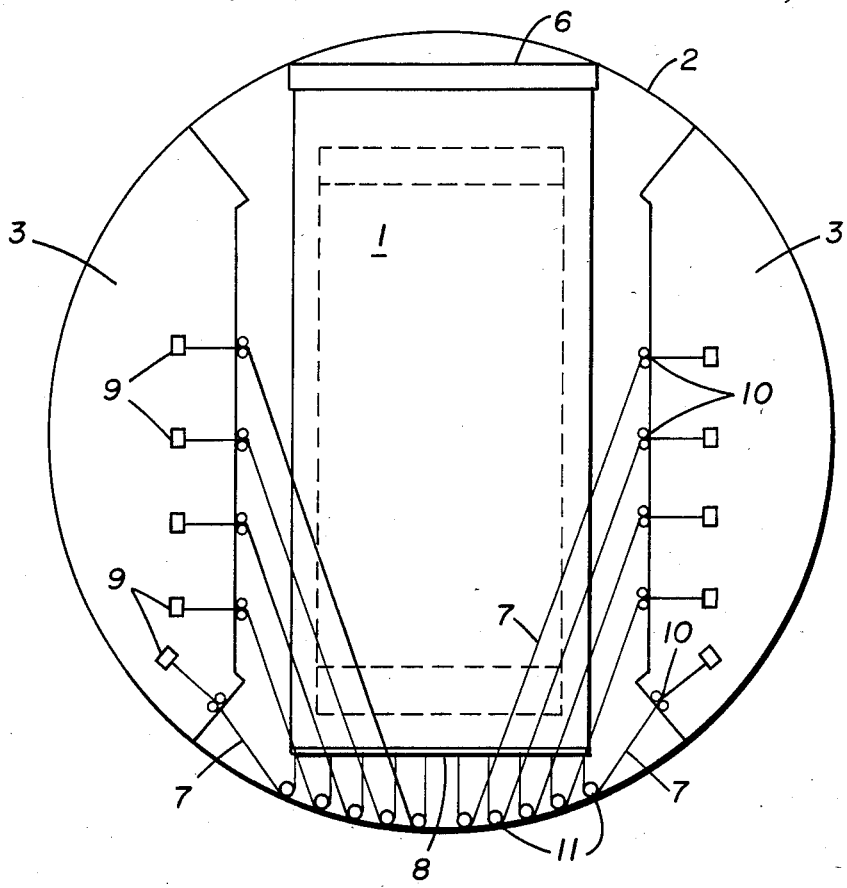
FIG. 1 schematically illustrates a plan view of a stadium having a football playing field of artificial turf with a rapid field conversion apparatus according to U.S. Pat. No. 4,399,954.
Figure 2:
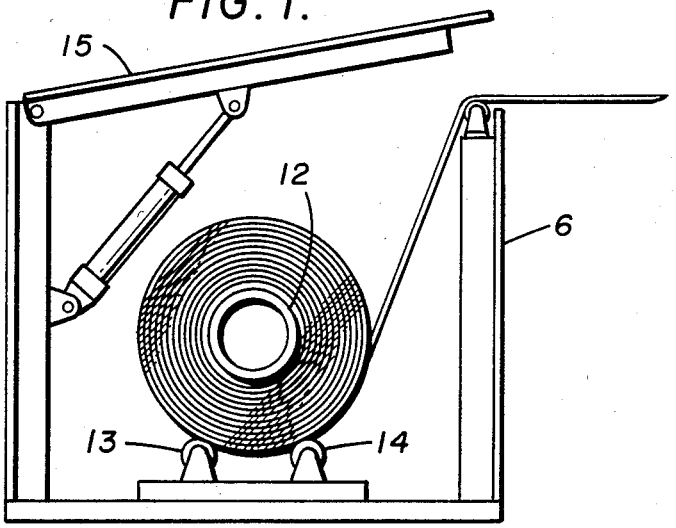
FIG. 2 schematically illustrates an elevation view of apparatus useful in rapidly converting a football playing field of artificial turf according to U.S. Pat. No. 4,399,954.
Figure 3:
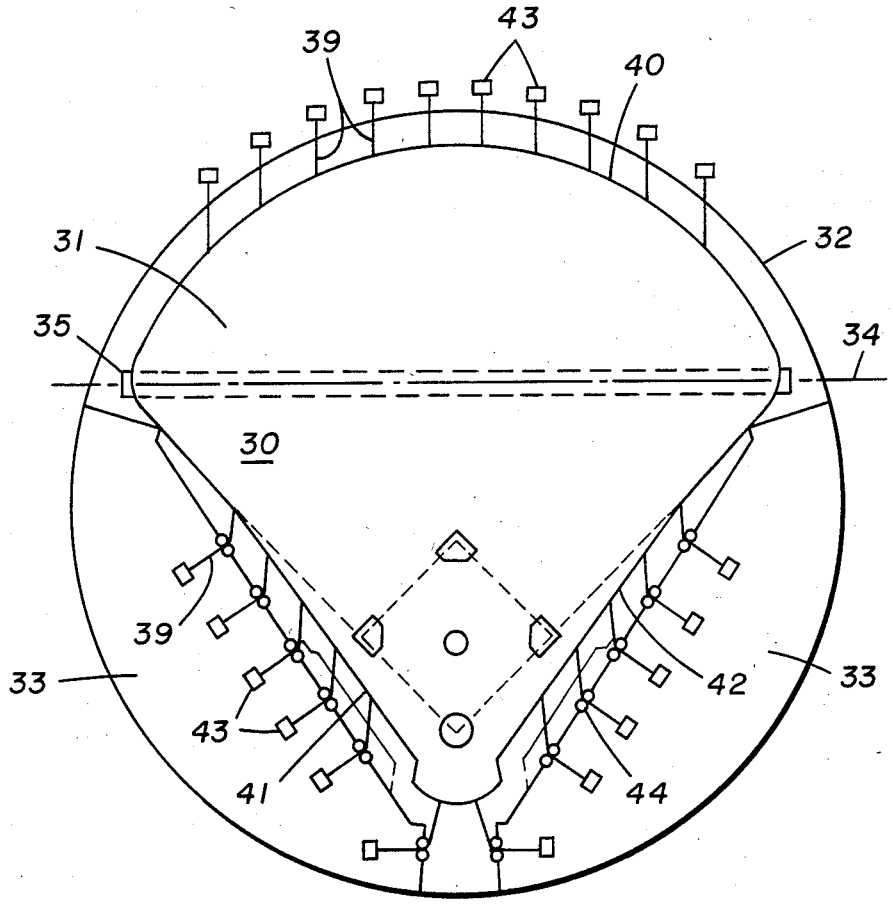
FIG. 3 schematically illustrates a plan view of a stadium having a non-rectangular-shaped baseball playing field of artificial turf with a rapid field conversion apparatus according to this invention.

Referring to FIG. 3 a central portion of a stadium having a non-rectangular-shaped playing field, suitable for instance for playing baseball, is schematically illustrated in plan view. The central portion of the stadium is bounded by the circular circumference 32 within which are seating segments 33 which can move in an arcuate direction within the circular circumference depending on the geometry of the desired playing field.

A baseball playing field comprises two large segments of artificial turf, an infield segment 30 and outfield segment 31, abutting in a line across a major dimension 34 across the outfield. Each segment of artificial turf can be pulled from a separate roll stored in pit 35, which traverses the outfield at the major dimension.

Each segment of artificial turf can be installed by pulling the leading margin of the segment over a pneumatic cushion provided by ports provided in a row adjacent a longitudinal opening in the cover of the pit. For instance the outfield segment 31 can be supported on a pneumatic cushion provided by blowers directing low pressure air from ports. To support artificial turf having a density of about 1.0 pounds per square foot, air can be provided at the ports at a pressure of less than about 0.5 inches of water. Air provided at pressures in the range of 0.1 to 0.5 inches of water (25–125 pascal) is generally adequate to support artificial turf having a density in the range of about 0.4–2.0 pounds per foot (2–10 Kilogram per square meter).

The air cushion supported artificial turf segments can be pulled from the rolls stored in the pit by cables 39 attached to the leading margins 40, 41 and 42 of the segments. In this regard the outfield segment 31 may have a generally curved leading margin 40, while the infield segment 30 may have two generally straight leading margins 41 and 42. The cables can be attached to grommets, or other suitable device, near the leading margin of the segment. Winches 43 located within seating segments 33 pull on cables 39 guided by capstans 44 to install the infield segment 30. Other winches 43 located in the stadium outside of the circular circumference 32 at the outfield section of the stadium pull on cables 39 to install the outfield segment 31.

To maintain the pneumatic cushion under the infield segment 30 it is necessary to provide removable air seal inserts in the openings in the infield segment at locations for the pitchers mound, home plate and first, second and third bases. Air seal inserts can be fabricated from any suitable fabric-like material which is substantially non-permeable, such as treated canvas or even artificial turf. The air seal inserts can be attached by any suitable fastening means, such as zippers, snaps, interlocking fasteners and the like. If a support roller for the roll of artificial turf is to be located under the area having the air seal inserts, for instance at the center of a baseball infield, it is necessary that the insert be of a thickness substantially the same as the artificial turf. If support rollers for the roll of artificial turf are located laterally displaced from the location of the air seal inserts, the inserts can be thinner than the artificial turf without impairing support for the artificial turf in the roll.

When the infield segment of artificial turf is fully deployed the blower is stopped to allow the pneumatic cushion to be relieved. The cables are removed; the air seal inserts are removed; and the bases and home plate are installed. A pitcher's mound is also installed for instance by building a mound of dirt. More preferably a hydraulically operated pitcher's mound is elevated into place from below grade.

Figure 4:
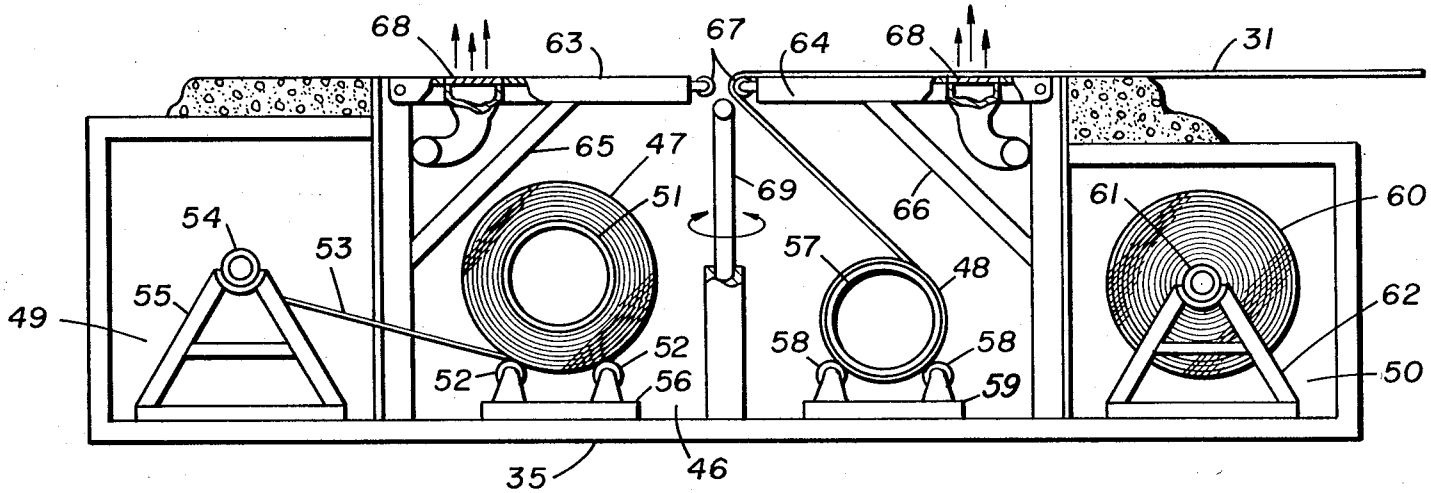
FIG. 4 schematically illustrates an elevation view of apparatus useful in rapidly converting a non-rectangular playing field of artificial turf according to this invention.

FIG. 4 illustrates a cross-sectional view of the pit 35 which accommodates rolls of the non-rectangular shaped infield and outfield segments of artificial turf.

Pit 35 comprises an elongated, rectangular central section 46 which accommodates a roll 47 of the infield segment of artificial turf and a roll 48 of the outfield segment of artificial turf. The pit also comprises a plurality of infield alcoves 49 and a plurality of outfield alcoves 50. Each alcove is generally of rectangular cubic shape with a width sufficient to accommodate and maintain a full roll of belt. In this regard the width of the alcove need only be about five feet or so. The alcove is enclosed except for the open face adjoining the central section 46 which allows the belt to be conveyed from the alcove to the roll of artificial turf.

The infield segment of artificial turf is depicted in a stored configuration wrapped in roll 47 around core 51. The core will generally comprise a hollow, metal cylinder, for instance steel pipe. The roll rests on a plurality of support rollers 52, arranged at intervals along the length of the roll. At least one of the support rollers, and preferably an entire line of support rollers, is powered to rotate the roll when the segment of artificial turf is being removed from the playing field. The support rollers are supported by roller base 56.

A section of belt is shown extending from belt core 54 to roll 47. The belt core 54 is supported at the ends of its axis by belt core brackets 55. The rolled belts are aligned with support rollers.

The outfield segment of artificial turf 31 is depicted in deployed configuration on the playing field. One end of the outfield segment is shown attached to core 57. The roll rests on support rollers 58. Powered support rollers rotate the roll when the segment of artificial turf is being removed from the playing field. The support rollers are supported by roller base 59. A roll of belt 60 is shown fully wrapped on belt core 61 supported at the ends of its axis by belt core bracket 62.

Above the central section 46 are removable lid sections 63 and 64 supported by brackets 65 and 66. At the central edge of each lid section is a roller 67 over which the segments of artificial turf can roll. Each of the removable lid sections also contain several ports 68 connected by piping to a remote blower for providing a cushion of air under the artificial turf segments to facilitate manipulation of the turf.

In the center of central section 46 are a plurality of rotatable support columns 69 having tee-shaped heads. When the segments of artificial turf are being installed or recovered, the support columns are rotated such that the tee-shaped heads are aligned parallel to the longitudinal opening between the lid sections. When the segments of artificial turf are deployed over the playing field or fully retracted for storage on rolls, the support columns are rotated such that the tee-shaped heads are aligned perpendicular to the longitudinal opening between the lid sections to support the central edges of the lid sections. The longitudinal opening between the lid section can be covered with a segmented cover to provide a stable surface. The segmented cover should have a smooth surface matching the surface of the lid when the artificial turf is stored on rolls in the pit. The segmented cover should be covered with artificial turf when the artificial turf segments are deployed over the playing field.

Figure 5:
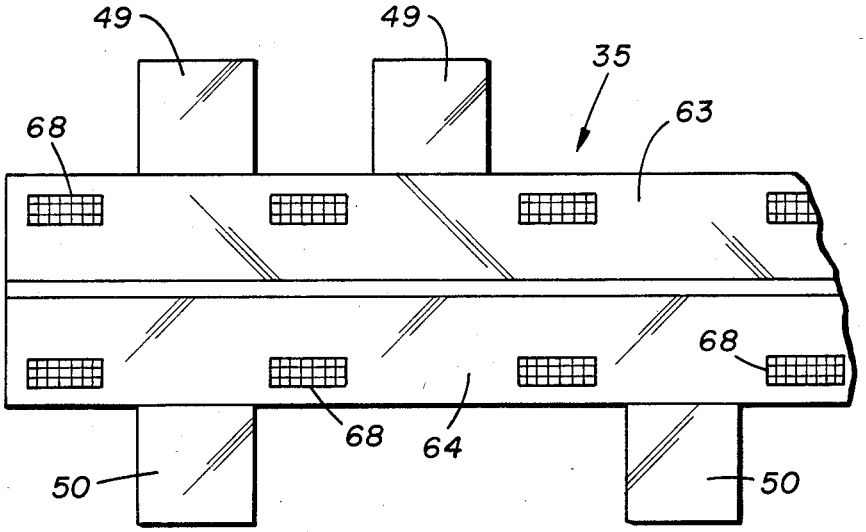
FIG. 5 schematically illustrates a partial plan view of an end section of a pit with belt storage alcoves useful in the apparatus of this invention.

FIG. 5 illustrates a plan view of a portion of the pit 35, having an infield segment cover 63 and a outfield segment cover 64. A plurality of ports 68 are located in each of the covers. The tops of the alcoves 49 and 50 would generally be covered with dirt or preferably asphalt or concrete as illustrated in FIG. 4.

To remove a segment of artificial turf from the playing field, the margin of artificial turf segments are freed and air seal inserts are provided where required, for instance in the infield portions where dirt playing surfaces are provided. Then blowers are started to provide an air cushion under the segment of artificial turf.

Once the artificial turf is supported by a pneumatic cushion the power rollers are started in rotation to drive the small roll of turf attached to the core. The power rollers can be driven by any suitable drive, for instance a variable gear drive.

As the segments of artificial turf are pulled from the playing field and wound on the roll the margin at an oblique angle to the axis of the core will progressively move inward from the end of the core toward the center. When the margin being wrapped on the core aligns with each belt, the power rollers must be stopped to allow each belt to be attached to the margin. The belt can be attached to the margin of the artificial turf segment by any suitable means, for instance zippers, hooks, interlocking fasteners, lacing and the like.

When the belt is attached the powered roller drive can be restarted to continue recovering the artificial turf segment on the roll until the traversing oblique margin aligns with the next belt or the turf is fully recovered. To avoid loss of air pressure from the blower, it may be necessary to shut down air flow to parts exposed by oblique margins of the artificial turf segment advancing toward the pit.

To deploy a segment of artificial turf onto the playing field, cables must be attached to the leading margin of the artificial turf segment. Generally the forward portion of the margin will be located in the center of the roll. Cables can be attached to suitable fasteners, for instance grommets, on the exposed leading margin.

Winches can be utilized to apply suitable tension on the cables to pull the leading margin of the artificial turf segment out of the pit and onto the playing field. The roll of artificial turf should rotate freely as the turf is pulled from the roll. In some cases to avoid damage to the leading margin from excessive stress at the point of cable connection, especially when only one or a few cables are connected to the artificial turf segment, it may be desireable to assist the roll rotation by operating the powered rollers.

To minimize friction of the artificial turf segment being drawn over the edge of the pit cover, it is generally desireable to provide rollers, or at least a rounded surface, at the center edge of the pit cover.

As the turf segment passes over the ports, a pneumatic cushion will develop under the turf to substantially reduce friction.

As the artificial turf segment unwraps from the roll, the belts are taken up on the belt cores which can be driven by gearmotors. As the oblique margin of the artificial turf segment unwraps from the roll, the pulling should be periodically interrupted to allow more cables to be attached and belts to be detached.

When the turf is fully deployed over the playing field, the air blower is shut down allowing the turf segment to settle onto the playing field and the cables can be detached. The support columns should be rotated to support heavy loads, for instance from vehicles, over the lid. The artificial turf covered, segmented covers can be installed in the longitudinal opening between lid covers to complete the artificial turf surface.

The foregoing description of embodiments of this invention is not intended to be a limitation to the scope of this invention. As will be apparent to those skilled in the art, many variations and modifications can be made to the apparatus of this invention as described in the above embodiments without departing from the spirit and scope of this invention.

I claim:

1. Apparatus for removably covering a playing field with a non-rectangular-shaped, large section of heavy duty artificial turf, said apparatus comprising:

(a) at least one non-rectangular-shaped, large section of heavy duty artificial turf comprising a mat of synthetic grass adhered to a shock-absorbing pad, said section having a straight edge and at least one oblique margin extending at an oblique angle from said straight edge;

(b) an elongated cylindrical core, wherein said straight edge of the section of artificial turf is fastened to said core;

(c) at least one belt removably attached to said oblique margin, said belt extending perpendicularly from said straight edge substantially as far as the most distant margin from said straight edge, and said belt having a thickness substantially the same as said artificial turf;

(d) at least one powered roller adapted to support and drive a roll of said turf on said core;

(e) means for pulling leading margins of said turf; and (f) means for developing a pneumatic cushion under said section when said section overlays said playing field.

2. The apparatus of claim 1 wherein said at least one belt has a width in the range of 0.3 to 1.5 meters.

3. The apparatus of claim 1 wherein said belt extends along substantially the entire length of said oblique margin.

4. Apparatus for removably covering a baseball field with two non-rectangular-shaped large sections of heavy duty artificial turf, said apparatus comprising (a) two non-rectangular-shaped, large sections of heavy duty artificial turf comprising a grass-like layer adhered to a shock-absorbing pad, each of said sections having a straight edge and at least one oblique margin extending at an oblique angle from said straight edge;

(b) two elongated cylindrical cores, wherein there is fastened to each of said cores a straight edge of one of said sections;

(c) at least one belt removably attached to each of said oblique margins and extending perpendicularly from said straight edge substantially as far as the most distant margin from said straight edge, said belt having a thickness substantially the same as said artificial turf;

(d) means for supporting and driving rolls of said sections on said cores;

(e) means for pulling leading margins of said sections; and (f) means for developing a pneumatic cushion under said sections when said sections overlay said baseball field.

* * * * *